US011412898B2

(12) United States Patent
Menashko

(10) Patent No.: US 11,412,898 B2
(45) Date of Patent: Aug. 16, 2022

(54) PERSONAL HYGIENE DEVICE

(71) Applicant: Israel Menashko, Flushing, NY (US)

(72) Inventor: Israel Menashko, Flushing, NY (US)

( * ) Notice: Subject to any disclaimer, the term of this patent is extended or adjusted under 35 U.S.C. 154(b) by 382 days.

(21) Appl. No.: 16/792,244

(22) Filed: Feb. 16, 2020

(65) Prior Publication Data

US 2020/0260920 A1 Aug. 20, 2020

Related U.S. Application Data

(60) Provisional application No. 62/806,981, filed on Feb. 18, 2019.

(51) Int. Cl.
*A47K 7/02* (2006.01)

(52) U.S. Cl.
CPC ..... *A47K 7/022* (2013.01)

(58) Field of Classification Search
CPC ..... A47K 7/022
USPC ..... 15/159.1, 104.001, 4, 21; 607/79
See application file for complete search history.

(56) References Cited

U.S. PATENT DOCUMENTS 3,311,713 A * 3/1967 Knuebel ..... H04M 1/05 379/430
D246,519 S * 11/1977 Kato ..... D14/205
5,606,743 A * 2/1997 Vogt ..... H04B 1/086 351/158
6,026,531 A * 2/2000 Pruitt ..... A47K 7/022 15/160
6,851,154 B1 * 2/2005 Neff ..... A47K 7/022 15/209.1
D784,957 S * 4/2017 Hsieh ..... D14/205
D811,362 S * 2/2018 Petersen ..... D14/205
D866,514 S * 11/2019 Lindof ..... D14/206
2009/0197749 A1 * 8/2009 Merkel ..... A43B 3/00 482/148
2011/0289710 A1 * 12/2011 Schrader ..... A47K 7/028 15/207.2
2014/0113771 A1 * 4/2014 Kubik ..... A63B 23/032 482/11
2016/0072177 A1 * 3/2016 Sharma ..... H04B 1/3827 343/702
2018/0272118 A1 * 9/2018 Goldwasser ..... A61N 1/0492
2019/0111557 A1 * 4/2019 Kemp ..... B25G 1/04
2019/0125196 A1 * 5/2019 Kline ..... A61B 5/6822
2020/0129102 A1 * 4/2020 Singh ..... A61B 5/486
2021/0046277 A1 * 2/2021 Samoocha ..... B08B 9/027

* cited by examiner

*Primary Examiner* — Lori L Baker
(74) *Attorney, Agent, or Firm* — Steven N. Fox, Esq.

(57) ABSTRACT

A personal hygiene device for use by a person having a stomach area and a back area. The device comprises a body comprising a first arm portion, a central body portion, and a second arm portion. The first and second arm portions extend outward from the central body portion. The first arm portion is spaced apart from the second arm portion so the body may fit substantially about the stomach area and back area of the person. Each of the first and second arm portions comprise an end portion. The device further comprises a first cleaning member engaged with the end portion of the first arm portion. The device further comprises a second cleaning member engaged with the end portion of the second arm portion. The second cleaning member substantially faces the first cleaning member.

9 Claims, 6 Drawing Sheets

PERSONAL HYGIENE DEVICE

CROSS-REFERENCE TO RELATED APPLICATIONS

This application claims the benefit of and priority to U.S. Provisional Patent Application Ser. No. 62/806,981 filed on Feb. 18, 2019, which is hereby incorporated into this specification by reference in its entirety.

BACKGROUND OF THE INVENTION

Many devices exist that allow a person to scrub or otherwise clean his or her body. However, such conventional devices have several disadvantages. By way of example, such conventional devices cannot clean two areas of the person's body at the same time.

SUMMARY OF THE INVENTION

The present invention is a personal hygiene device for use by a person to clean or otherwise attend to his or her stomach area and back area. The device comprises a body comprising a first arm portion, a central body portion, and a second arm portion. The first and second arm portions extend outward from the central body portion. The first arm portion is spaced apart from the second arm portion so the body may fit substantially about the stomach area and back area of the person. Each of the first and second arm portions comprise an end portion. The device further comprises a first cleaning member engaged with the end portion of the first arm portion. The device further comprises a second cleaning member engaged with the end portion of the second arm portion. The second cleaning member substantially faces the first cleaning member. The device according to the present invention provides significant advantages over conventional devices. By way of example, the device according to the present invention provides easier mobility to wash different part's of a person's the same time such as back and stomach, legs, and neck.

BRIEF DESCRIPTION OF THE DRAWINGS

The following description of the invention will be more fully understood with reference to the accompanying drawings in which.

DESCRIPTION OF THE INVENTION

Figure 1:
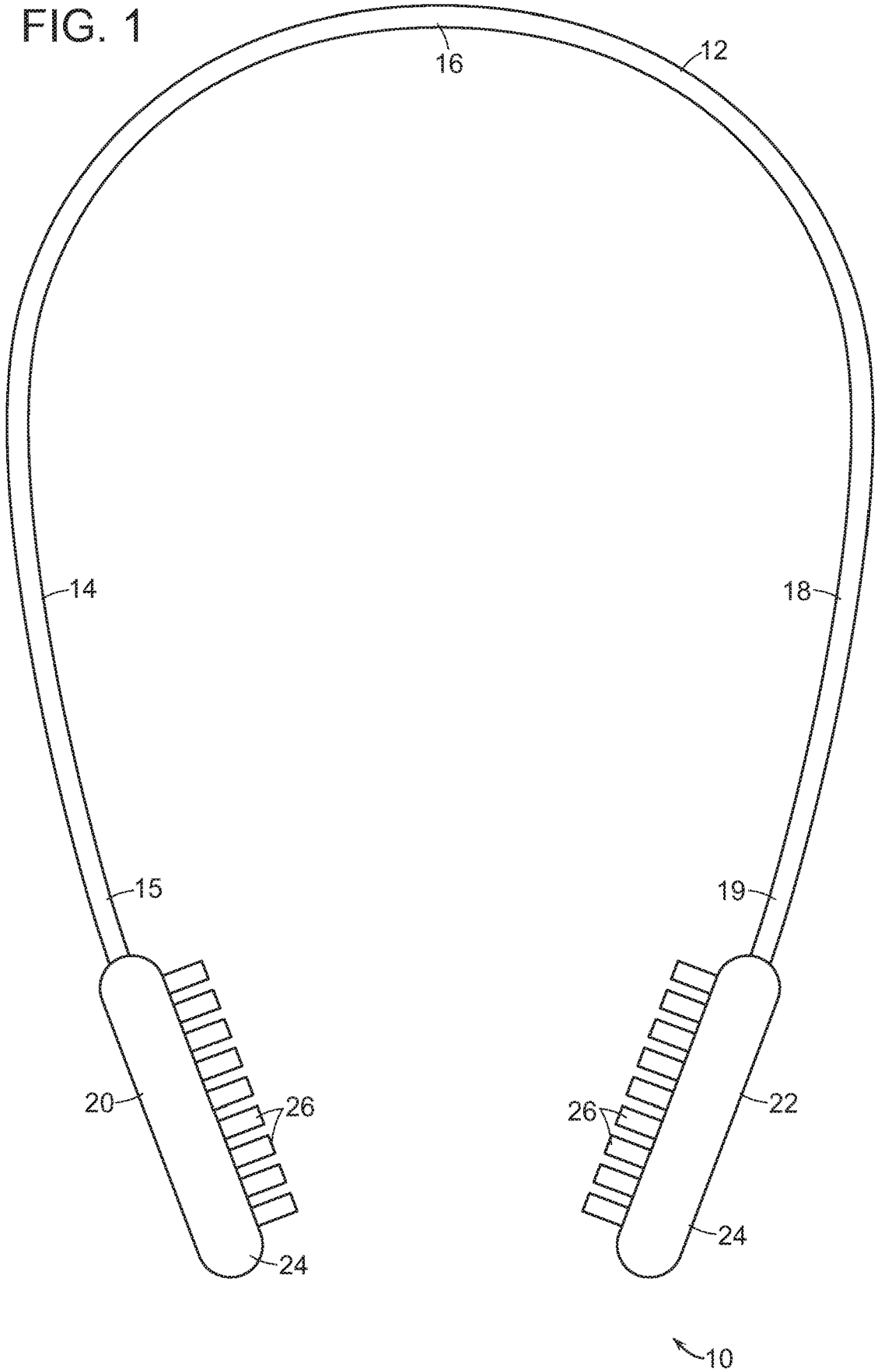
FIG. 1 is a perspective view of a personal hygiene device according to a first embodiment of the present invention showing cleaning members in the form of bristle brushes.
Figure 2:
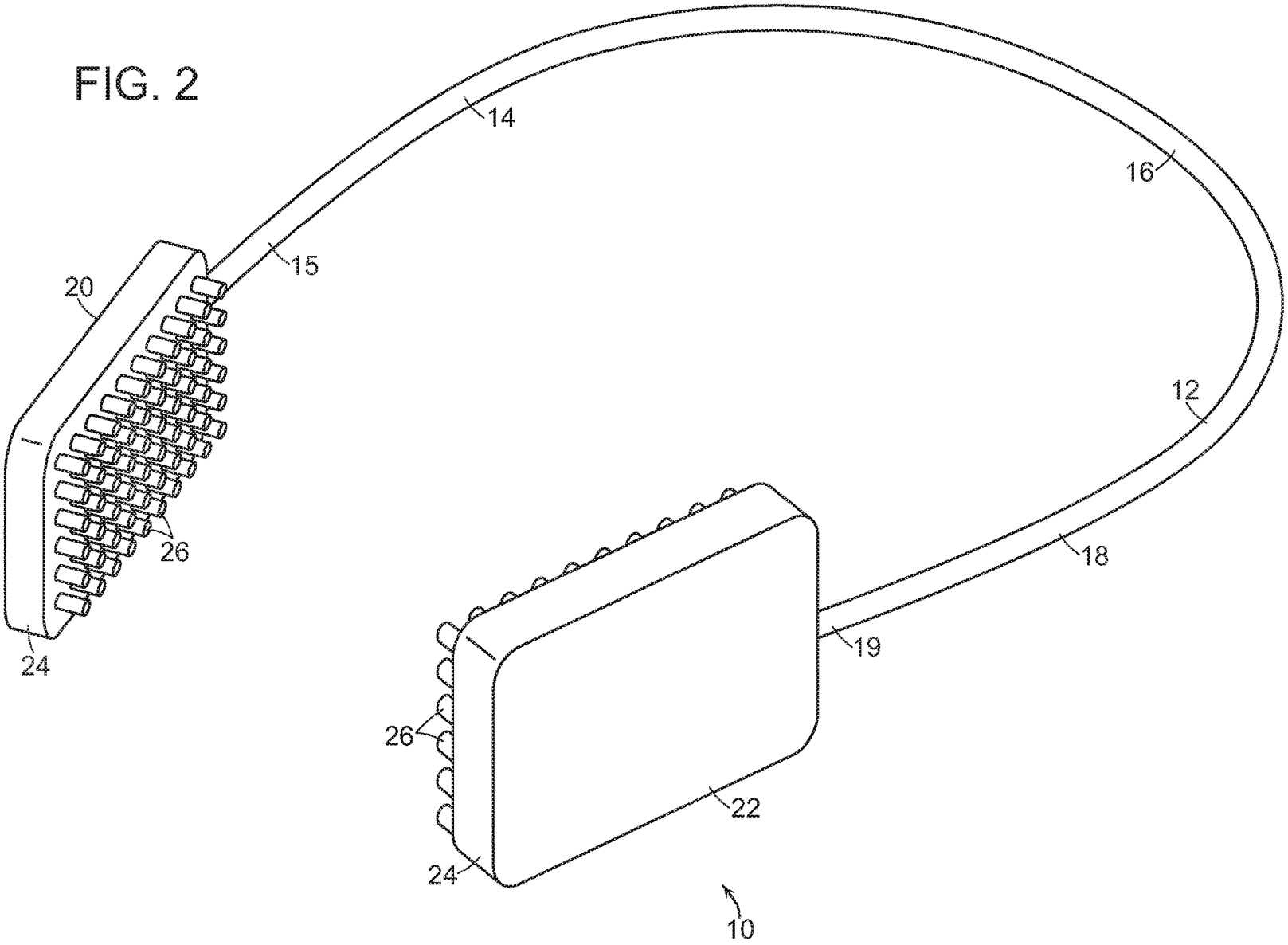
FIG. 2 is a front view of the personal hygiene device according to the first embodiment of the present invention.

Referring to FIGS. 1 and 2, the present invention is a personal hygiene device 10 that may be used by a person to wash, clean and/or scrub two areas of the person's body at the same time such as the stomach and back area or a single area if desired. In the embodiment shown, device 10 generally comprises a body 12 comprising a first arm portion 14, a central body portion 16, and a second arm portion 18. First and second arm portions 14 and 18 extend outward from central body portion 16 in a substantially u-shaped manner. First arm portion 14 is moveable or flexible relative to second arm portion 18. First arm portion 14 is spaced apart from second arm portion 18 so body 12 can fit substantially about the stomach area of a person. First arm portion 14 has an end portion 15. Second arm portion 18 has an end portion 19. Body 12 may be made from one or more pieces and from a variety of materials. In the embodiment shown, body 12 is a single tube made from plastic that may be fabricated by conventional processes. Device 10 further comprises a first cleaning member 20 engaged or connected with end portion 15 of first arm portion 14 by a threaded cavity in first cleaning member 20 (not shown) adapted to receive threads of end portion 15 (not shown). Device 10 further comprises a second cleaning member 22 engaged or connected with end portion 19 of second arm portion 18 by a threaded cavity in second cleaning member 22 (not shown) adapted to receive threads of end portion 19 (not shown). First cleaning member 20 substantially faces second cleaning member 22. In the shown embodiment shown, each of first and second cleaning members 20 and 22 are brushes 24 having a plurality of bristles 26. A wide variety of other types of cleaning members may be used such as a sponge brush, a fabric mesh brush or any other previously developed or futurely developed cleaning member. Although not show, first cleaning member 20 may be one type of cleaning member, such as a textile fabric, while second cleaning member 22 may be a different type of cleaning member such as a brush. Although not shown, one or more gripping members, such as cushions, could be attached to central portion 16 of body 12 to allow a person to grip and manipulate device 10.

Figure 3:
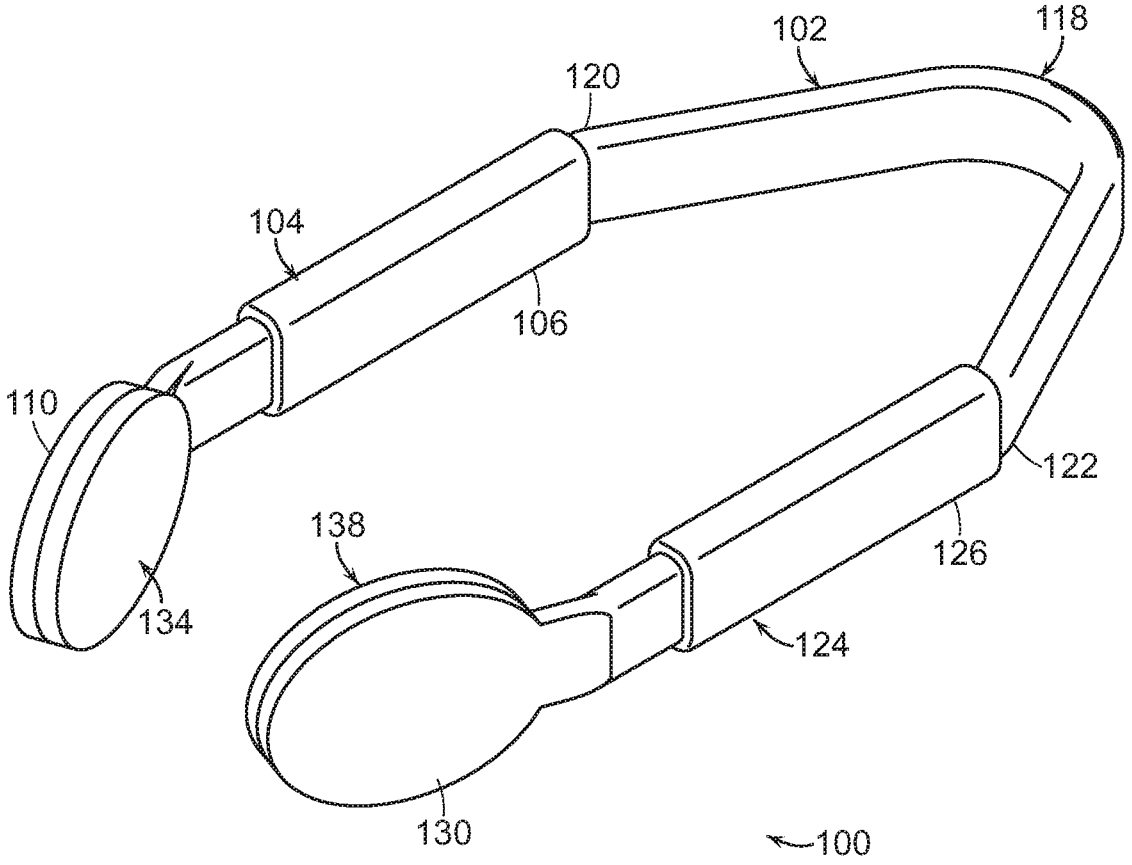
FIG. 3 is a perspective view of a personal hygiene device according to a second embodiment of the present invention showing cleaning members in the form of sponge brushes.
Figure 4:
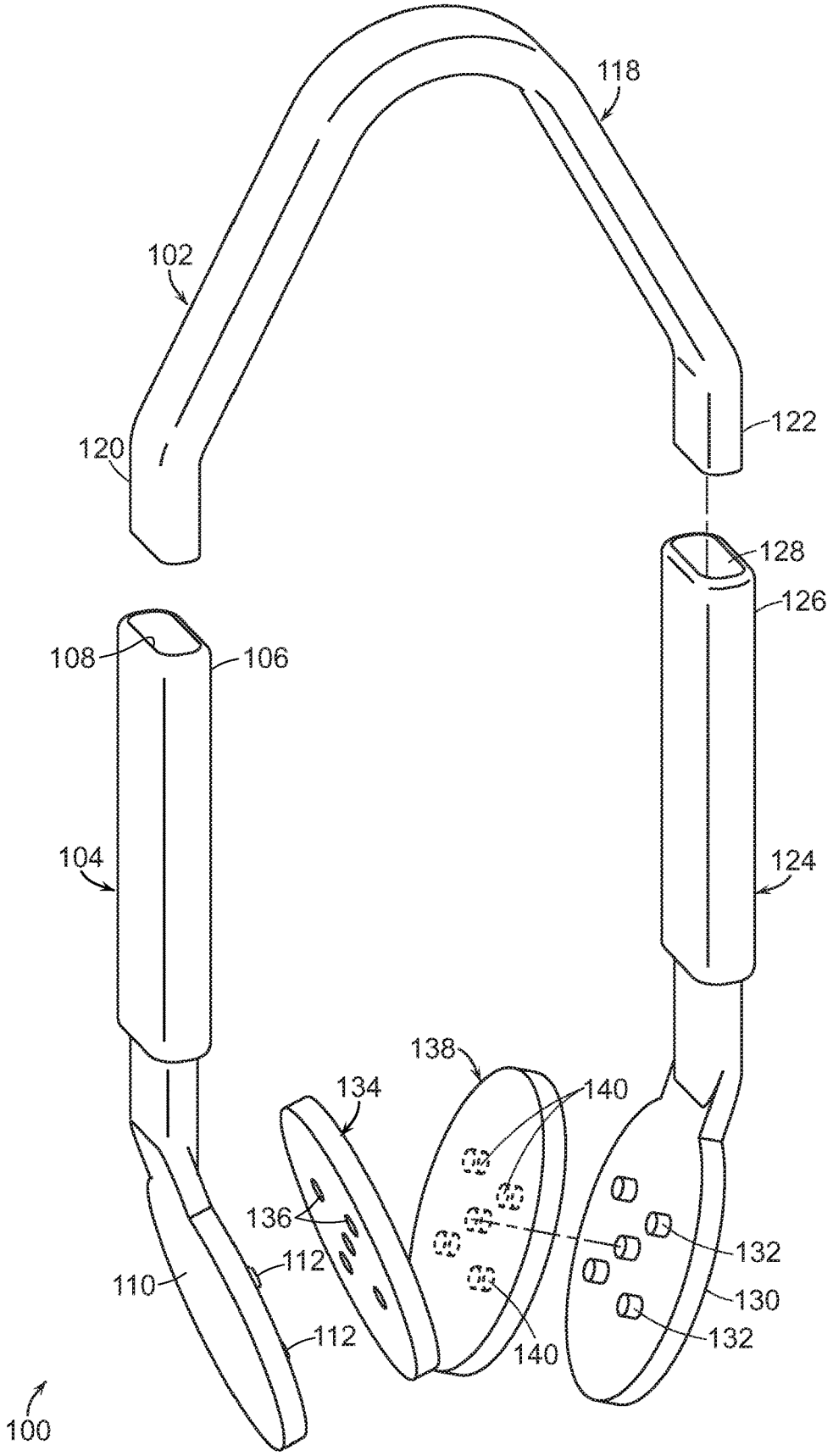
FIG. 4 is an exploded view of the personal hygiene device according to the second embodiment of the present invention.
Figure 5:
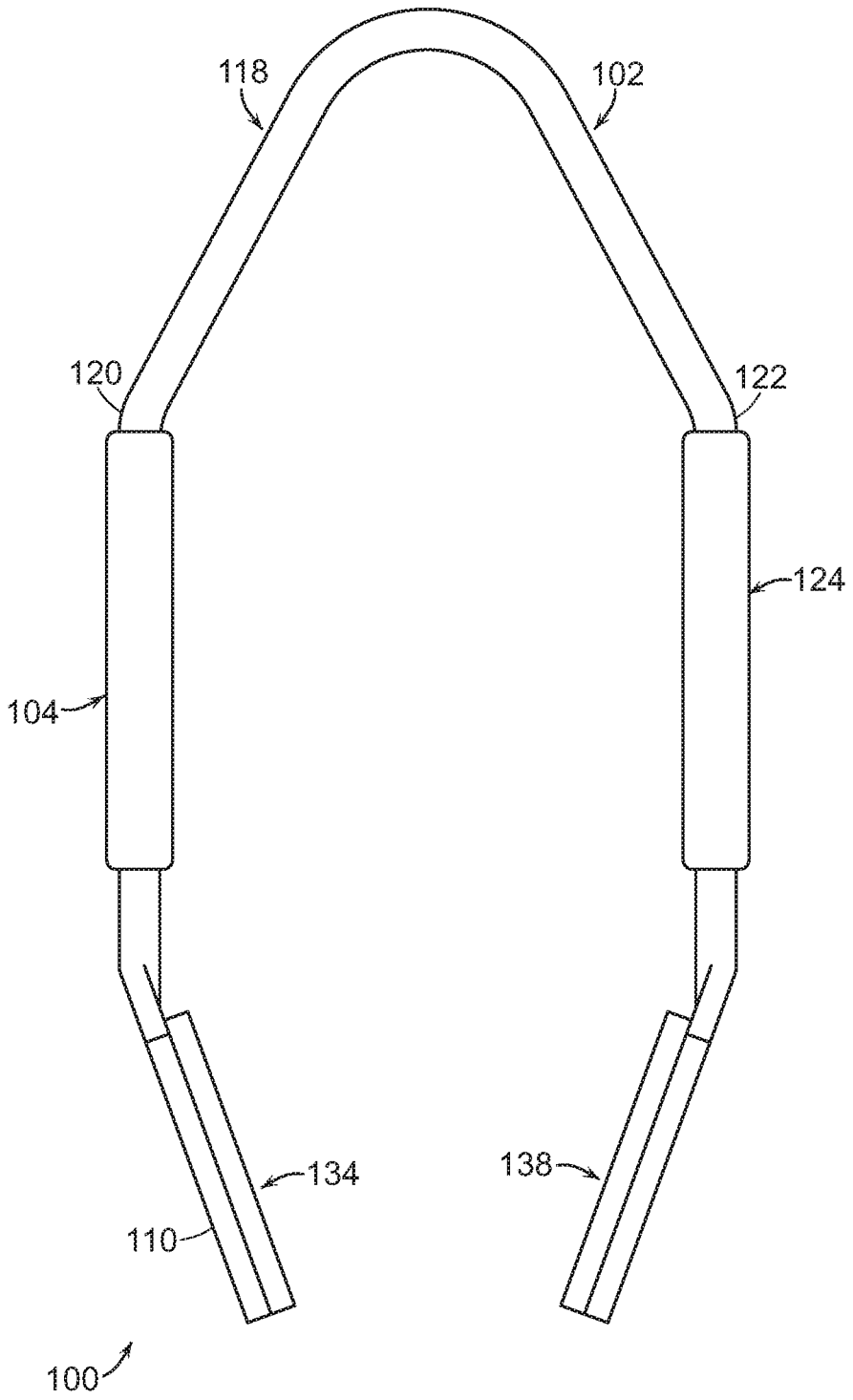
FIG. 5 is a front view of the personal hygiene device according to the second embodiment of the present invention.
Figure 6:
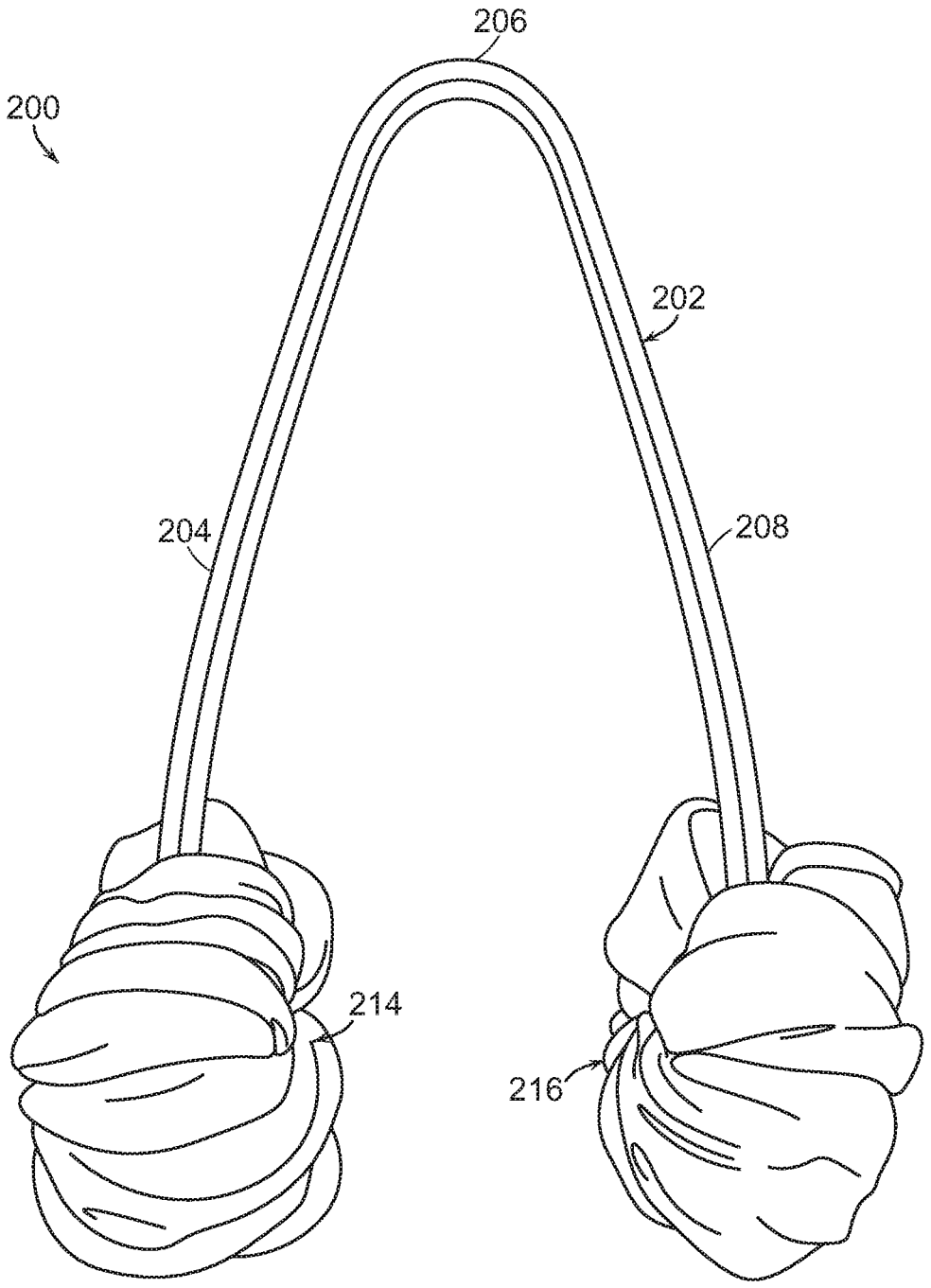
FIG. 6 is a perspective view of a personal hygiene device according to a third embodiment of the present invention showing cleaning members in the form of fabric mesh brushes.

Referring to FIGS. 3-5, where a personal hygiene device 100 according to a second embodiment of the present invention is shown. Device 100 comprises a body 102 comprising a first arm 104, a central body 118, and a second arm 124. First and second arms 104 and 124 extend outward from central body 118 in a substantially u-shaped manner. Central body 118 comprises first and second end portions 120 and 122. Central body 118 is made from plastic or any other conventional material and fabricated by conventional methods such as injection molding. First arm 104 comprises a first end portion 106 having a cavity 108 adapted to securely receive first end portion 120 of central body 118. First arm 106 further comprises a second end portion 110 comprising protrusions 112. Second arm 124 comprises a first end portion 126 having a cavity 128 adapted to securely receive second end portion 122 of central body 118. Second arm 124 further comprises a second end portion 130 comprising protrusions 132. First and second arms 106 and 124 are made from plastic or any other conventional material and fabricated by conventional methods such as injection molding.

Device 100 further comprises a first cleaning member 134 engaged or connected with first end portion 110 of first arm 106. First cleaning member 134 has a plurality of mounting holes 136 adapted to receive protrusions 112 of first end portion 110 of first arm 106. Device 100 further comprises a second cleaning member 138 engaged or connected with end portion 130 of second arm 124. Second cleaning member 138 has a plurality of mounting holes 140 adapted to receive protrusions 132 of second end portion 130 of second arm 124. First cleaning member 134 substantially faces second cleaning member 138. In the shown embodiment shown, each of first and second cleaning members 134 and 138 is a sponge brush. A wide variety of other types of cleaning members may be used such as a bristle brush, or a fabric mesh brush. First cleaning member 134 may be one type of cleaning member, such as a fabric mesh brush, while second cleaning member 138 may be a different type of cleaning member such as a bristle brush. Although not shown, one or more gripping members, such as cushions, could be attached to central portion 118 of body 102 to allow a person to grip and manipulate device 100.

Referring to FIG. 5, where a personal hygiene device 200 according to a third embodiment of the present invention is shown that may be used by a person to wash, clean and/or scrub two areas of the person's body at the same time such as the stomach and back area or a single area if desired. In the embodiment shown, device 200 generally comprises a body 202 comprising a first arm portion 204, a central body portion 206, and a second arm portion 208. First and second arm portions 204 and 208 extend outward from central body portion 206 in a substantially u-shaped manner. First arm portion 204 is moveable or flexible relative to second arm portion 208. First arm portion 204 is spaced apart from second arm portion 208 so body 202 can fit substantially about the stomach area of a person. First arm portion 204 has an end portion 210 (not shown). Second arm portion 208 has an end portion 212 (not shown). Body 12 may be made from one or more pieces and from a variety of materials. In the embodiment shown, body 202 is a single tube made from plastic that may be fabricated by conventional processes. Device 200 further comprises a first cleaning member 214 engaged or connected with end portion 210 (not shown) of first arm portion 204. Device 200 further comprises a second cleaning member 216 engaged or connected with end portion 212 (not shown) of second arm portion 208. First cleaning member 214 substantially faces second cleaning member 216. In the shown embodiment shown, each of first and second cleaning members 214 and 216 are made from a fabric sheet wrapped around end portions 210 and 212 respectively, to form a fabric mesh. Each of end portions 210 and 212 may have an opening for the fabric sheet to pass thru and be secured by conventional means such as a knot or adhesive.

Devices 10, 100 and 200 according to the present invention provides significant advantages over conventional devices. By way of example, devices 10 and 100 provide easier mobility to wash different part's of a person's the same time such as back and stomach, legs, and neck.

While particular embodiments of the invention have been shown and described, it will be obvious to those skilled in the art that changes and modifications may be made without departing from the sprit and scope of the claimed invention.

What is claimed:

1. A personal hygiene device for use by a person having a stomach area and a back area, comprising:

a body comprising a first arm portion, a central body portion, and a second arm portion; said first and second arm portions extending outward from said central body portion; said first arm portion being spaced apart from said second arm portion and sized and configured for fitting substantially about the stomach area and back area of the person; each of said first and second arm portions comprise an end portion;

a first cleaning member engaged with said end portion of said first arm portion; and a second cleaning member engaged with said end portion of said second arm portion; said second cleaning member substantially facing said first cleaning member.

2. The personal hygiene device of claim 1, wherein said first arm portion is flexible relative to said second arm portion.

3. The personal hygiene device of claim 1, wherein said central body portion and said first and second end portions are made from a single piece of material.

4. The personal hygiene device of claim 1, wherein said first cleaning member is a brush having bristles.

5. The personal hygiene device of claim 4, wherein said second cleaning member is a brush having bristles.

6. The personal hygiene device of claim 1, wherein said first cleaning member is a sponge.

7. The personal hygiene device of claim 6, wherein said second cleaning member is a sponge.

8. The personal hygiene device of claim 1, wherein said first cleaning member is a fabric mesh.

9. The personal hygiene device of claim 8, wherein said second cleaning member is a fabric mesh.

* * * * *